US010293621B2

(12) United States Patent
Ozawa et al.

(10) Patent No.: US 10,293,621 B2
(45) Date of Patent: May 21, 2019

(54) PRINTING DEVICE, PRINTING METHOD, AND NONVOLATILE COMPUTER-READABLE RECORDING MEDIUM

(71) Applicant: CASIO COMPUTER CO., LTD., Shibuya-ku, Tokyo (JP)

(72) Inventors: Takeo Ozawa, Akishima (JP); Masaki Ito, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/694,570

(22) Filed: Sep. 1, 2017

(65) Prior Publication Data

US 2018/0079223 A1 Mar. 22, 2018

(30) Foreign Application Priority Data

Sep. 21, 2016 (JP) ..... 2016-184163

(51) Int. Cl.
*B41J 2/355* (2006.01)

(52) U.S. Cl.
CPC ..... *B41J 2/3551* (2013.01); *B41J 2/3555* (2013.01)

(58) Field of Classification Search
CPC ..... B41J 2/3555; B41J 2/3551
See application file for complete search history.

(56) References Cited

U.S. PATENT DOCUMENTS 5,051,756 A * 9/1991 Nomura ..... B41J 2/3551 347/189
5,706,043 A * 1/1998 Okada ..... B41J 2/36 347/185
5,741,079 A * 4/1998 Hayama ..... B41J 2/365 347/191
5,826,994 A * 10/1998 Palmer ..... B41J 2/3551 400/615.2
7,304,658 B2 * 12/2007 Naito ..... B41J 2/365 347/195
2004/0119806 A1 * 6/2004 Miyajima ..... B41J 2/3555 347/195

(Continued)

FOREIGN PATENT DOCUMENTS

EP 0882596 A2 * 12/1998 ..... B41J 2/3551
JP 07025052 A 1/1995
JP 10181063 A 7/1998

(Continued)

*Primary Examiner* — Shelby L Fidler
(74) *Attorney, Agent, or Firm* — Holtz, Holtz & Volek PC

(57) ABSTRACT

A printing device includes:
a thermal head including heater elements arrayed into a line along an array direction intersecting a conveying direction of a printing medium; and
controller that causes the thermal head to print onto the printing medium based on multiple line print data, each of the multiple line print data being data into which print data is divided along the array direction.
The controller performs either of a first energization control to energize the heater elements in one line cycle for printing based on a single line print data among the multiple line print data and a second energization control to energize the heater elements so that a non-energization period in which the heater elements are not energized is included in the one line cycle, depending on a temperature of the thermal head.

15 Claims, 9 Drawing Sheets

(56) References Cited

U.S. PATENT DOCUMENTS

2013/0208071 A1* 8/2013 Kano ..... B41J 2/36
347/194

FOREIGN PATENT DOCUMENTS

| | | | |
|---|---|---|---|
| JP | 2011088370 | A | 5/2011 |
| JP | 2011126140 | A | 6/2011 |
| JP | 2011213014 | A | 10/2011 |

* cited by examiner

PRINTING DEVICE, PRINTING METHOD, AND NONVOLATILE COMPUTER-READABLE RECORDING MEDIUM

CROSS-REFERENCE TO RELATED APPLICATION

This application claims the benefit of Japanese Patent Application No. 2016-184163, filed on Sep. 21, 2016, the entire disclosure of which is incorporated by reference herein.

FIELD

This application relates generally to a printing device, a printing method executed by the printing device, and a nonvolatile computer-readable recording medium on which a program is stored.

BACKGROUND

Conventionally, thermal printers are known in which energization of heater elements provided to a thermal head is controlled for desired printing onto a printing medium. Such a thermal printer is described in, for example, Unexamined Japanese Patent Application Kokai Publication No. 2011-126140.

If the heater elements are continuously heated during an energization period, the temperature of the heater elements will significantly rises. When the peak temperature of the heater elements becomes too high, a phenomenon called broken ribbon in which an ink ribbon melts and breaks or a phenomenon called sticking in which the thermal head sticks to the ink ribbon or the printing medium may occur and then the print quality may deteriorate.

SUMMARY

The printing device according to the present disclosure is a printing device, including:

a thermal head including heater elements arrayed into a line along an array direction intersecting a conveying direction of a printing medium; and controller that causes the thermal head print to onto the printing medium based on multiple line print data, each of the multiple line print data being data into which print data is divided along the array direction, wherein the controller performs either of a first energization control to energize the heater elements in one line cycle for printing based on a single line print data among the multiple line print data and a second energization control to energize the heater elements so that a non-energization period in which the heater elements are not energized is included in the one line cycle, depending on a temperature of the thermal head.

The printing method according to the present disclosure is a printing method executed by controller of a printing device, wherein the printing device further includes a thermal head including heater elements arrayed into a line along an array direction intersecting a conveying direction of a printing medium, and the printing method includes causing the thermal head to print onto the printing medium based on multiple line print data, each of the multiple line print data being data into which print data is divided along the array direction, and performing either of a first energization control to energize the heater elements in one line cycle for printing based on a single line print data among the multiple line print data and a second energization control to energize the heater elements so that a non-energization period in which the heater elements are not energized is included in the one line cycle, depending on a temperature of the thermal head.

The printing method according to the present disclosure is a printing method executed by controller of a printing device, wherein the printing device further includes a thermal head including heater elements arrayed into a line, and the printing method includes causing the thermal head to print onto a printing medium by heating an ink ribbon with the heater elements based on multiple line print data, each of the multiple line print data being data into which print data is divided along the array direction, and performing either of a first energization control to energize the heater elements in one line cycle for printing based on a single line print data among the multiple line print data and a second energization control to energize the heater elements so that a non-energization period in which the heater elements are not energized is included in the one line cycle, depending on a likelihood of the ink ribbon breaking or a likelihood of the ink ribbon or the printing medium sticking to the thermal head.

The nonvolatile computer-readable recording medium according to the present disclosure is a nonvolatile recording medium on which a computer-readable program is stored, the program causing controller of a printing device to execute the following processing:

causing a thermal head provided to the printing device to print onto the printing medium based on multiple line print data, each of the multiple line print data being data into which print data is divided along the array direction, and performing either of a first energization control to energize the heater elements in one line cycle for printing based on a single line print data among the multiple line print data and a second energization control to energize the heater elements so that a non-energization period in which the heater elements are not energized is included in the one line cycle, depending on a temperature of the thermal head.

BRIEF DESCRIPTION OF THE DRAWINGS

A more complete understanding of this application can be obtained when the following detailed description is considered in conjunction with the following drawings, in which.

DETAILED DESCRIPTION

Embodiment 1

Figure 1:
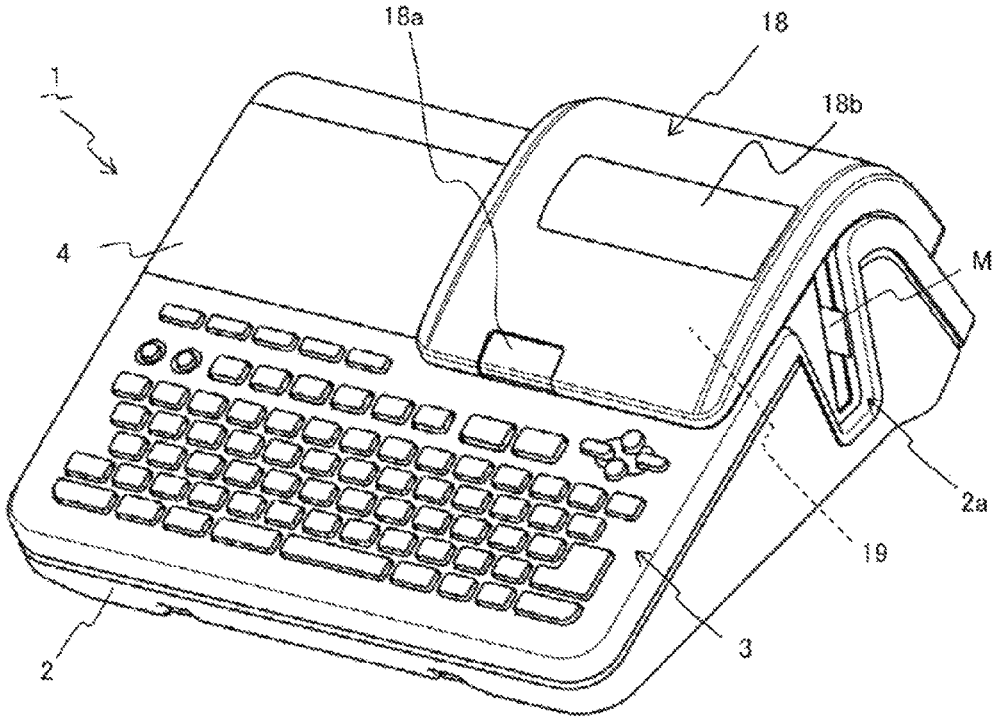
FIG. 1 is a perspective view of the printing device according to Embodiment 1 of the present disclosure.

FIG. 1 is a perspective view of a printing device 1 according to Embodiment 1 of the present disclosure. The printing device 1 is a printing device including a thermal head printing onto a printing medium and, for example, a label printer printing onto an elongated printing medium M in the single path system. The following explanation will be made using a thermal transfer label printer using an ink ribbon by way of example. However, the printing method is not particularly restricted. For example, the thermal method using thermal paper may be used. The printing medium M is, for example, a tape member having a base having an adhesive layer and a releasable paper attached to the base in a releasable manner to cover the adhesive layer. However, the printing medium M may be a tape member with no releasable paper.

The printing device 1 comprises, as shown in FIG. 1, a device enclosure 2, an input device 3, a display 4, an open/close cover 18, and a cassette housing 19. The input device 3, the display 4, and the open/close cover 18 are disposed on the top surface of the device enclosure 2. Moreover, although not shown, the device enclosure 2 is provided with a power supply cord connection terminal, an external device connection terminal, a storage medium insertion opening, and the like.

The input device 3 comprises various keys such as input keys, an arrow key, a conversion key, and an enter key. The display 4 is, for example, a liquid crystal display panel and displays characters and the like corresponding to input from the input device 3, a selection menu for various settings, messages regarding various kinds of processing, and the like. Moreover, the display 4 displays, during printing, contents such as characters and/or graphics ordered to print onto the printing medium M (hereafter termed the print content). Furthermore, the display 4 may display the progress of the printing. Here, the display 4 may be provided with a touch panel unit and in such a case, the display 4 functions as a part of the input device 3.

The open/close cover 18 is disposed at the top of the cassette housing 19 in an openable/closable manner. The open/close cover 18 is opened as a button 18*a* is pressed down. The open/close cover 18 has a window 18*b* formed so that whether a tape cassette 30 (see FIG. 2) is housed in the cassette housing 19 can be checked visually even when the open/close cover 18 is closed. Moreover, a discharge slot 2*a* is formed on a side of the device enclosure 2. The printing medium M printed within the printing device 1 is discharged through the discharge slot 2*a* to outside the device.

Figure 2:
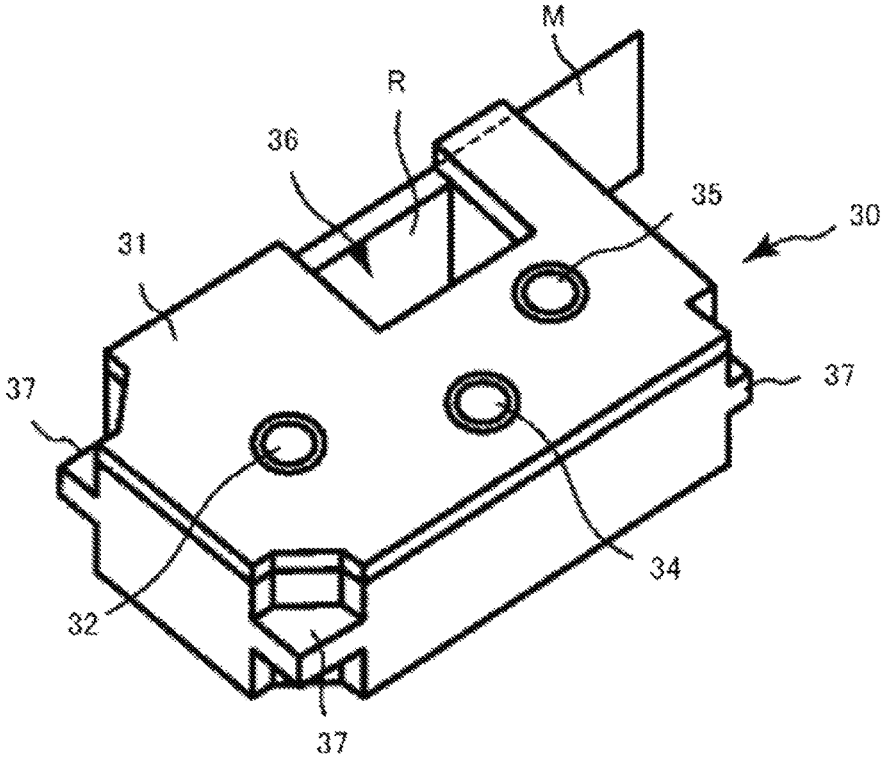
FIG. 2 is a perspective view of a tape cassette to be housed in the printing device according to Embodiment 1 of the present disclosure.
Figure 3:
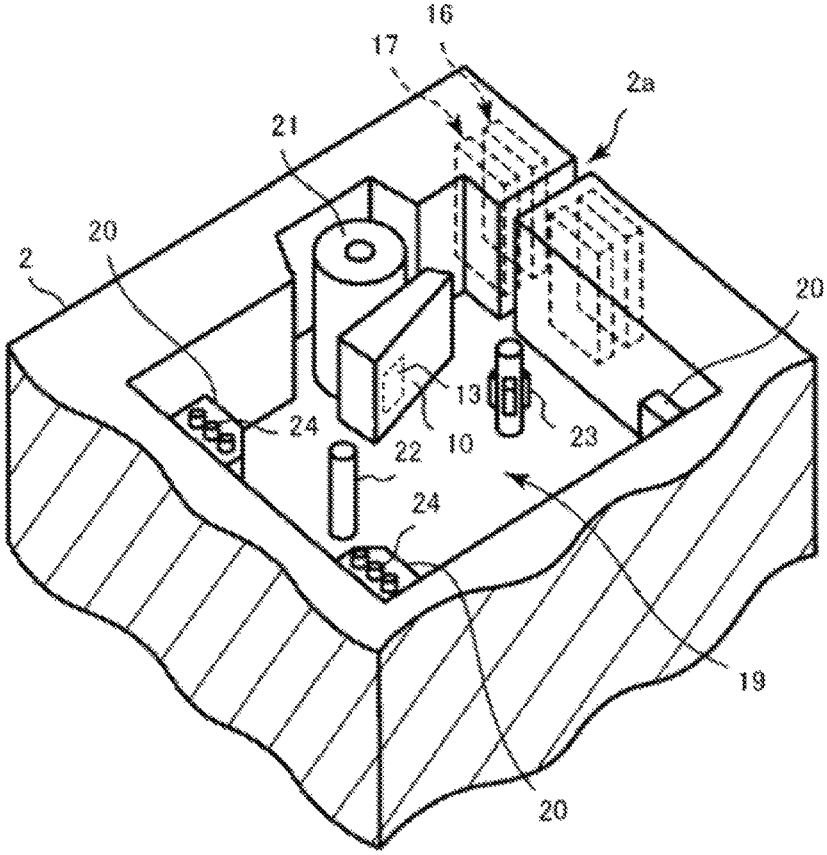
FIG. 3 is a perspective view of the cassette housing of the printing device according to Embodiment 1 of the present disclosure.
Figure 4:
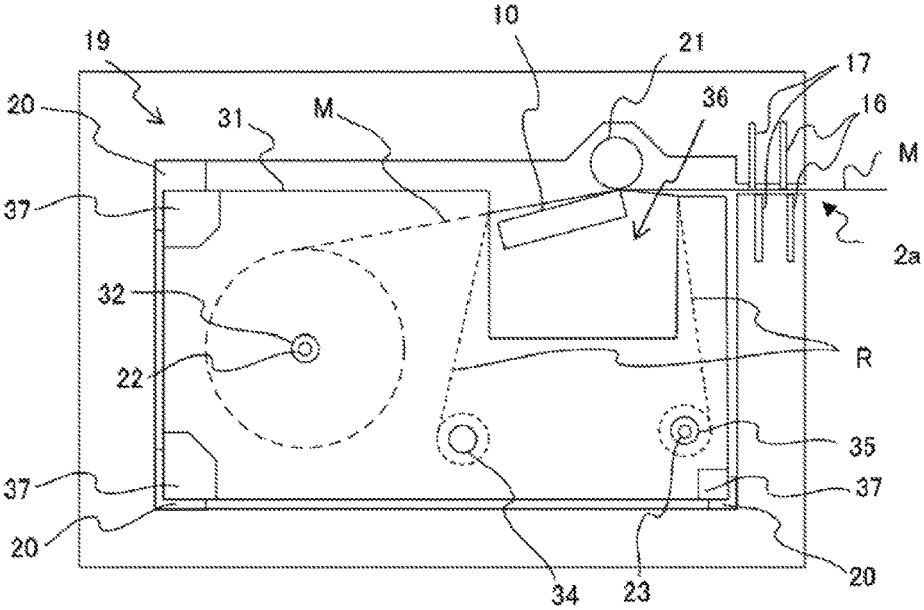
FIG. 4 is a cross-sectional view of the printing device according to Embodiment 1 of the present disclosure.

FIG. 2 is a perspective view of the tape cassette 30 to be housed in the printing device 1. FIG. 3 is a perspective view of the cassette housing 19 of the printing device 1. FIG. 4 is a cross-sectional view of the printing device 1. The tape cassette 30 shown in FIG. 2 is detachably housed in the cassette housing 19 shown in FIG. 3. FIG. 4 shows the state in which the tape cassette 30 is housed in the cassette housing 19.

The tape cassette 30 has, as shown in FIG. 2, a cassette case 31 housing the printing medium M and an ink ribbon R. A thermal head inserter 36 and engagers 37 are formed in the cassette case 31. The cassette case 31 is provided with a tape core 32, an ink ribbon feed core 34, and an ink ribbon roll-up core 35. The printing medium M is wound around the tape core 32 into a roll within the cassette case 31. Moreover, the thermal transfer ink ribbon R is wound around the ink ribbon feed core 34 into a roll within the cassette case 31 with the leading end wound around the ink ribbon roll-up core 35.

The cassette housing 19 of the device enclosure 2 is provided with multiple cassette receivers 20 for supporting the tape cassette 30 at a given position as shown in FIG. 3. Moreover, the cassette receivers 20 are provided with tape width detection switches 24 for detecting the width of a tape (the printing medium M) housed in the tape cassette 30. The tape width detection switches 24 function as detection means for detecting the width of the printing medium M.

The cassette housing 19 is further provided with a thermal head 10 having heater elements printing onto the printing medium M, a platen roller 21 that is conveyance means for conveying the printing medium M, a tape core engaging shaft 22, and an ink ribbon roll-up drive shaft 23. Furthermore, a thermistor 13 is embedded in the thermal head 10. The thermistor 13 functions as measurement means for measuring the temperature of the thermal head 10.

With the tape cassette 30 being housed in the cassette housing 19, as shown in FIG. 4, the engagers 37 provided to the cassette case 31 are supported by the cassette receivers 20 provided to the cassette housing 19. Then, the thermal head 10 is inserted into the thermal head inserter 36 formed in the cassette case 31. Moreover, the tape core 32 of the tape cassette 30 engages with the tape core engaging shaft 22. Furthermore, the ink ribbon roll-up core 35 engages with the ink ribbon roll-up drive shaft 23.

As a print order is entered into the printing device 1, the printing medium M is dispensed from the tape core 32 by rotation of the platen roller 21. At this point, the ink ribbon roll-up drive shaft 23 rotates in sync with the platen roller 21, whereby the ink ribbon R is dispensed from the ink ribbon feed core 34 along with the printing medium M. As a result, the printing medium M and the ink ribbon R are conveyed in an overlapped state. Then, while passing between the thermal head 10 and the platen roller 21, the ink ribbon R is heated by the thermal head 10, whereby ink is transferred to the printing medium M for printing.

The used ink ribbon R after passing between the thermal head 10 and the platen roller 21 is rolled up by the ink ribbon roll-up core 35. On the other hand, the printed printing medium M after passing between the thermal head 10 and the platen roller 21 is cut by a half-cut mechanism 16 and a full-cut mechanism 17 and discharged from the discharge slot 2*a*.

Figure 5:
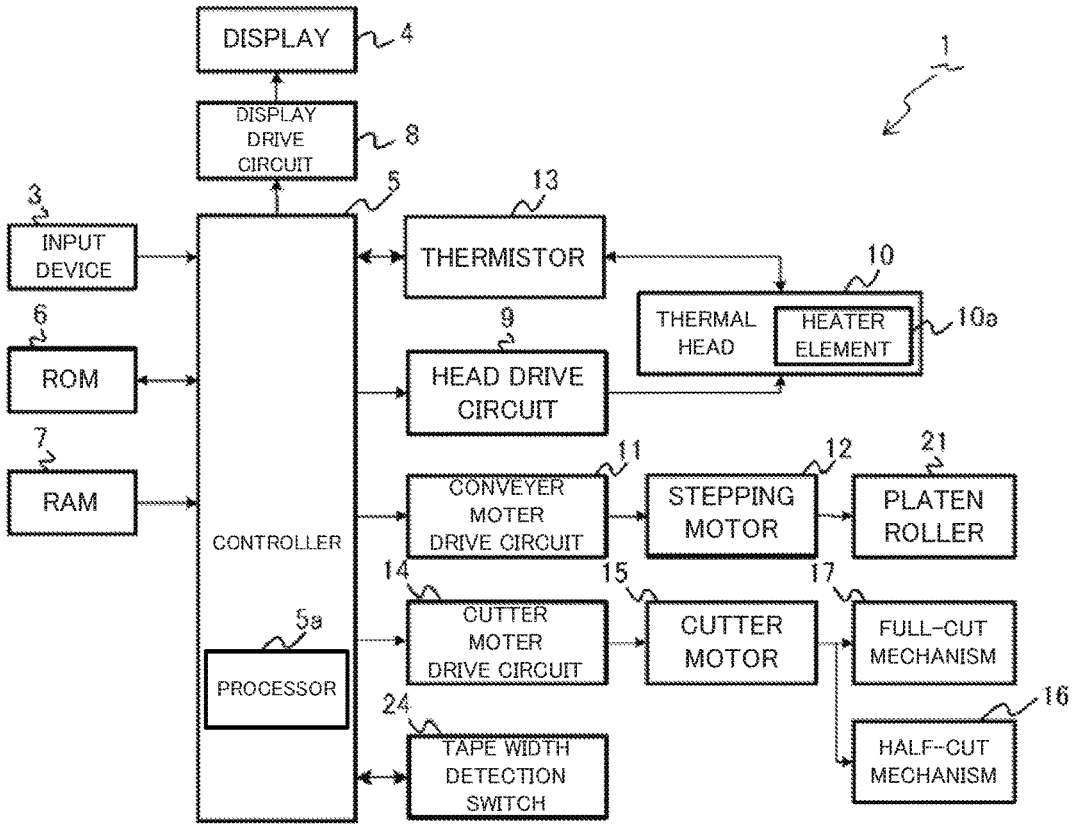
FIG. 5 is a control block diagram of the printing device according to Embodiment 1 of the present disclosure.

FIG. 5 is a control block diagram of the printing device 1. The printing device 1 comprises, in addition to the input device 3, the display 4, the thermal head 10, the thermistor 13, the half-cut mechanism 16, the full-cut mechanism 17, the platen roller 21, and the tape width detection switches 24, a controller 5, a read only memory (ROM) 6, a random access memory (RAM) 7, a display drive circuit 8, a head drive circuit 9, a conveyer motor drive circuit 11, a stepping motor 12, a cutter motor drive circuit 14, and a cutter motor 15. Here, the controller 5, the ROM 6, and the RAM 7 cooperate to function as the computer of the printing device 1.

The controller 5 includes a processor 5*a* such as a central processing unit (CPU). The controller 5 loads on the RAM 7 and executes programs stored in the ROM 6 to control the operations of the parts of the printing device 1. In other words, the controller 5 is head control means for controlling the thermal head 10, conveyance control means for controlling the platen roller 21, and cut control means for controlling the cut mechanisms.

The ROM 6 stores a print program for printing onto the printing medium M and various data necessary for executing the print program (for example, fonts and the like). Here, the ROM 6 also functions as a storage medium storing programs readable by the controller 5.

The RAM 7 functions as an input data memory storing information regarding printing (hereafter termed the printing information). Moreover, the RAM 7 also functions as a print data memory storing data generated based on the printing information and presenting a pattern of print contents to be formed on the printing medium (hereafter termed the print data). Furthermore, the RAM 7 also functions as a display data memory storing display data generated based on the printing information.

The display drive circuit 8 controls the display 4 based on the display data stored in the RAM 7. The display 4 may display, for example, the print contents in a manner making the progress of the printing recognizable under the control of the display drive circuit 8.

The head drive circuit 9 energizes heater elements 10*a* based on the print data and a signal. This signal is, for example, a strobe signal. The thermal head 10 is a print head having heater elements 10*a* arrayed in the main scanning direction. As the head drive circuit 9 selectively energizes the heater elements 10*a* according to the print data during a period in which a strobe signal transmitted by the controller 5 is ON (namely, an energization period), the thermal head 10 heats the ink ribbon R with the heater elements 10*a* to print onto the printing medium M by thermal transfer line by line.

The conveyer motor drive circuit 11 drives the stepping motor 12. The stepping motor 12 drives the platen roller 21. The platen roller 21 is conveyance means rotating by the motive power of the stepping motor 12 for conveying the printing medium M in the longitudinal direction of the printing medium M (the sub-scanning direction).

The cutter motor drive circuit 14 drives the cutter motor 15. The half-cut mechanism 16 and the full-cut mechanism 17 operate by the motive force of the cutter motor 15. The full-cut mechanism 17 full-cuts the printing medium M. The half-cut mechanism 16 half-cuts the printing medium M. The full-cut is an operation to cut the base of the printing medium M together with the releasable paper along the width direction. The half-cut is an operation to cut only the base along the width direction.

In the printing device 1 having the above configuration, the controller 5 that is head control means operates as follows.

First, for realizing gradation control regardless of the performance of the processor 5*a*, the controller 5 changes print data one time during an energization-controlled period in which the thermal head 10 prints one line. More specifically, the controller 5 changes print data retained by the head drive circuit 9 from primary energization data to historical energization data in an energization-controlled period. Here, the primary energization data are first print data of the printing device 1 and print data presenting a print pattern to be formed on a line to print during that energization-controlled period (hereafter termed the target line). Moreover, the historical energization data is second print data of the printing device 1 and print data generated based on the print data of a preceding line that is printed before the target line (for example, the line prior to the target line by one line).

Figure 8:
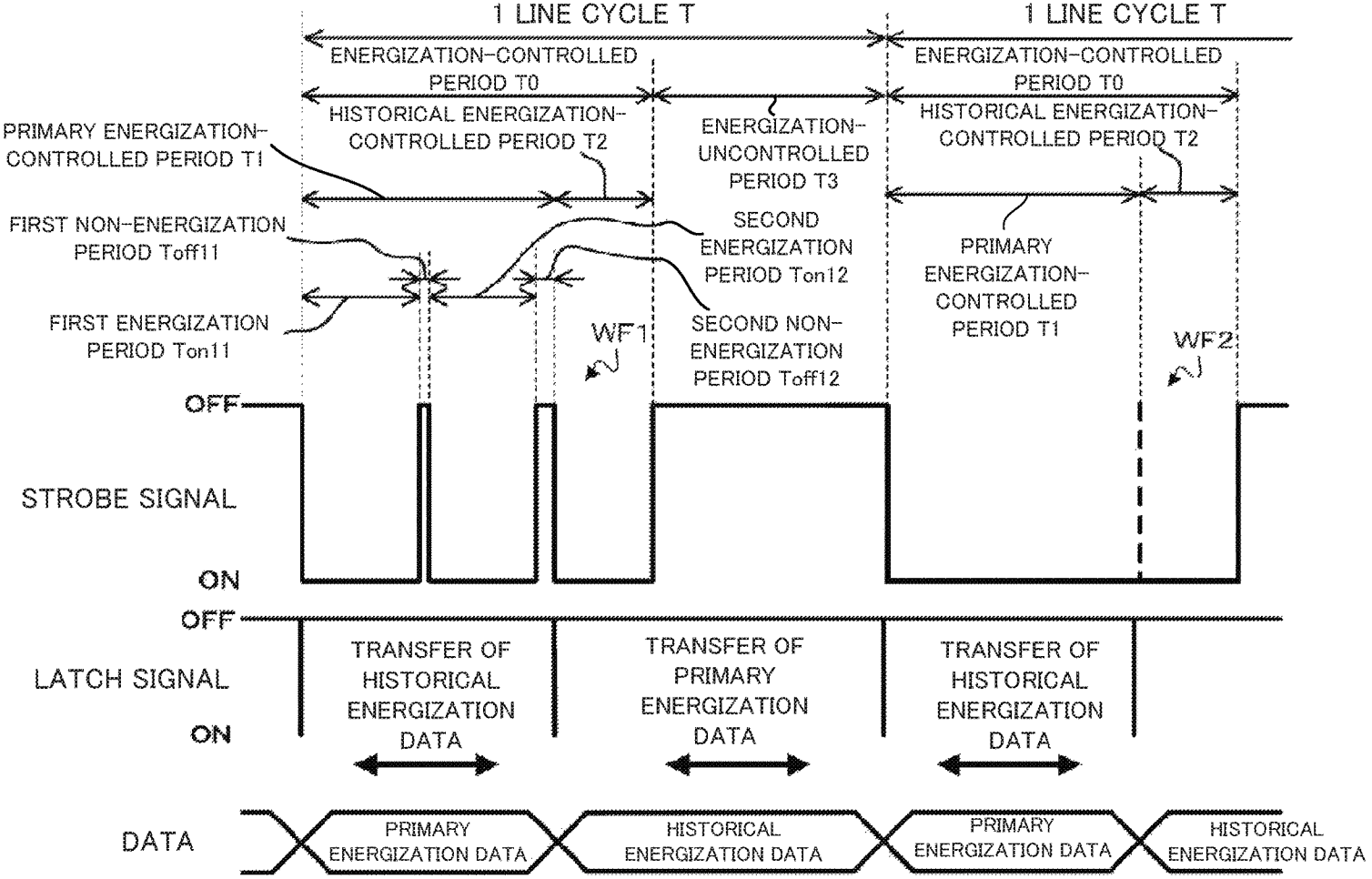
FIG. 8 is a chart showing an exemplary strobe signal and latch signal according to Embodiment 1 of the present disclosure.

Second, for preventing the temperature of the heater elements 10*a* from becoming too high, the controller 5 controls the thermal head 10 so that a non-energization period is established in an energization-controlled period based on the temperature of the thermal head 10. More specifically, the controller 5 generates a strobe signal indicating that a non-energization period is established in an energization-controlled period based on the temperature measured by the thermistor 13 and outputs the strobe signal to the head drive circuit 9. Here, "a non-energization period being established based on the temperature" means that, for example, a non-energization period is established for some temperatures and no non-energization period is established for some other temperatures; whether to establish a non-energization period depends on the temperature. Here, as shown in FIG. 8, each one line cycle T includes an energization-controlled period T0 and an energization-uncontrolled period T3. Each one line cycle T corresponds to a period for printing line print data into which print data is divided along the array direction of heater elements. The energization-controlled period T0 includes a period for energizing the heater elements 10*a* based on the content of each line print data. The energization-uncontrolled period T3 is established after the energization-controlled period T0 in each one line cycle T and does not include a period for energizing the heater elements 10*a*. Moreover, the non-energization period is a period for not energizing the heater elements 10*a* regardless of the content of each line print data in an energization-controlled period T0. In other words, the non-energization period is a period during which a strobe signal is OFF in an energization-controlled period.

As the controller 5 operates as described above, the printing device 1 can perform high quality printing regardless of the processing performance of the processor 5*a* while suppressing occurrence of broken ribbon and sticking. Although not particularly restricted, the above-described control by the controller 5 is particularly preferable when the tape width (ribbon width) is small. This is because in cases in which print data is of a high rate of black letters and the temperature of the thermal head is high, sticking or broken ribbon is more likely to occur compared to when the tape width (ribbon width) is large. Here, major factors causing sticking or broken ribbon when the tape width (ribbon width) is small include the following. First, a narrow tape is printed in one part even with a high rate of black letters. In one part printing, the print speed is relatively high compared to printing a wide tape with a high rate of black letters in three parts. Therefore, heat tends to remain after moving on to the next line and the thermal head easily becomes hot.

Second, if the thermal head width is larger than the ribbon width, the thermal head is pressed against the ribbon with a larger force. Here, the reason that the thermal head width is larger than the ribbon width is that the thermal head has to deal with tapes of multiple different widths.

For establishing a non-energization period in an energization-controlled period, the controller 5 may establish a non-energization period in the primary energization-controlled period of an energization-controlled period. The primary energization-controlled period is a period in which the thermal head 10 is controlled based on primary energization data. Establishing a non-energization period in a primary energization-controlled period is desirable in terms of extra time for controlling a strobe signal compared to establishing a non-energization period in a historical energization-controlled period. Here, the historical energization-controlled period is a period established for adjusting gradation and usually shorter than a primary energization-controlled period. Moreover, in this specification, a strobe signal is normally ON during a historical energization-controlled period. Therefore, a historical energization-controlled period is a historical energization period.

Furthermore, in establishing a non-energization period in a primary energization-controlled period, the controller 5 may establish multiple non-energization periods including a first non-energization period and a second non-energization period intermittently in a primary energization-controlled period. In such a case, it is desirable that the second non-energization period is longer and later than the first non-energization period. Moreover, it is desirable that the second non-energization period is established in the end of a primary energization-controlled period. This is because as proceeding on to the second half of an energization-controlled period, the temperature of the heater elements 10*a* is possibly higher. Moreover, if the temperature of the heater elements 10*a* is high, it is possible to perform printing in a non-energization state and suppress deterioration in the printing efficiency.

Figure 6:
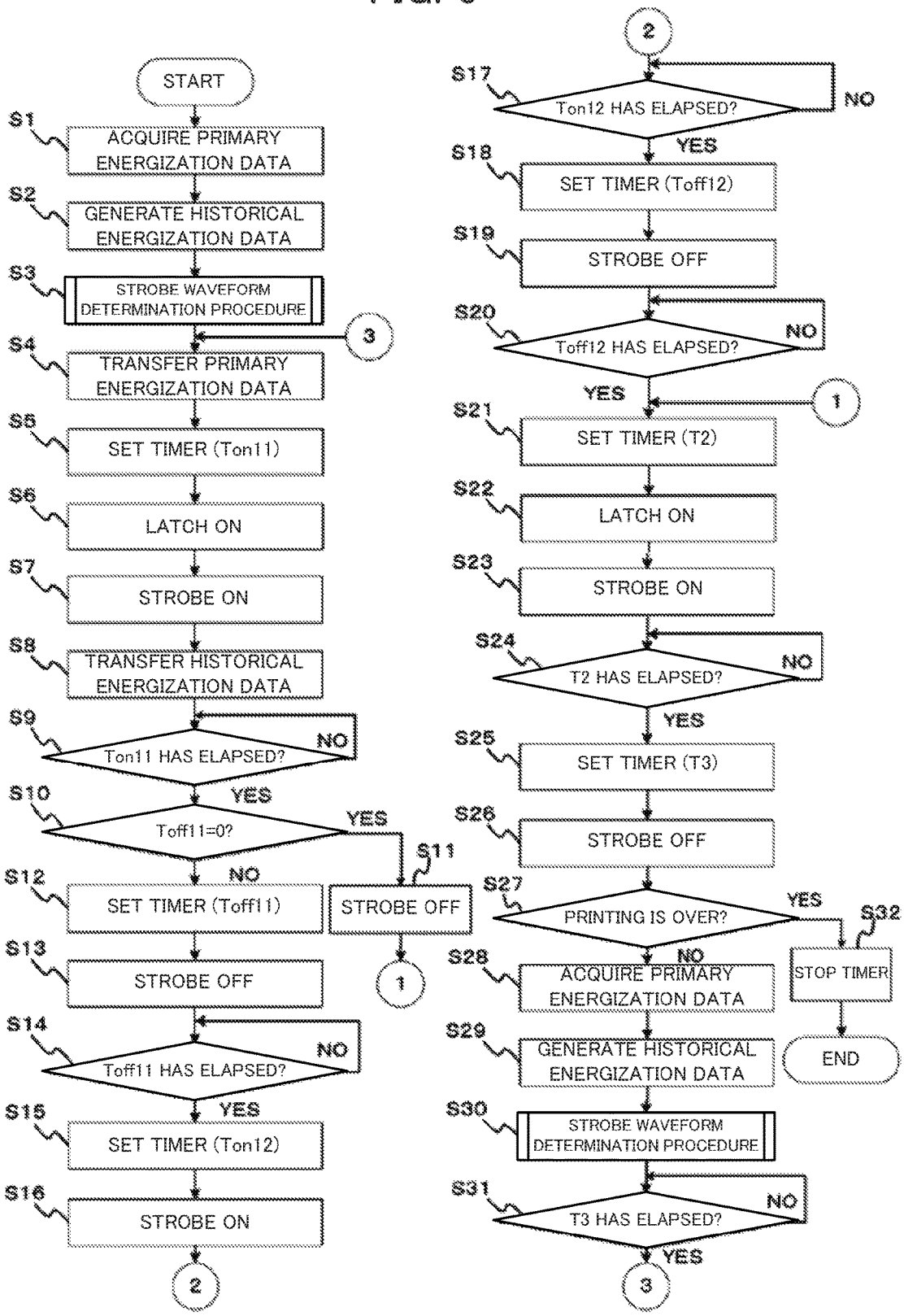
FIG. 6 is a flowchart showing an example of the print control procedure according to Embodiment 1 of the present disclosure.
Figure 7:
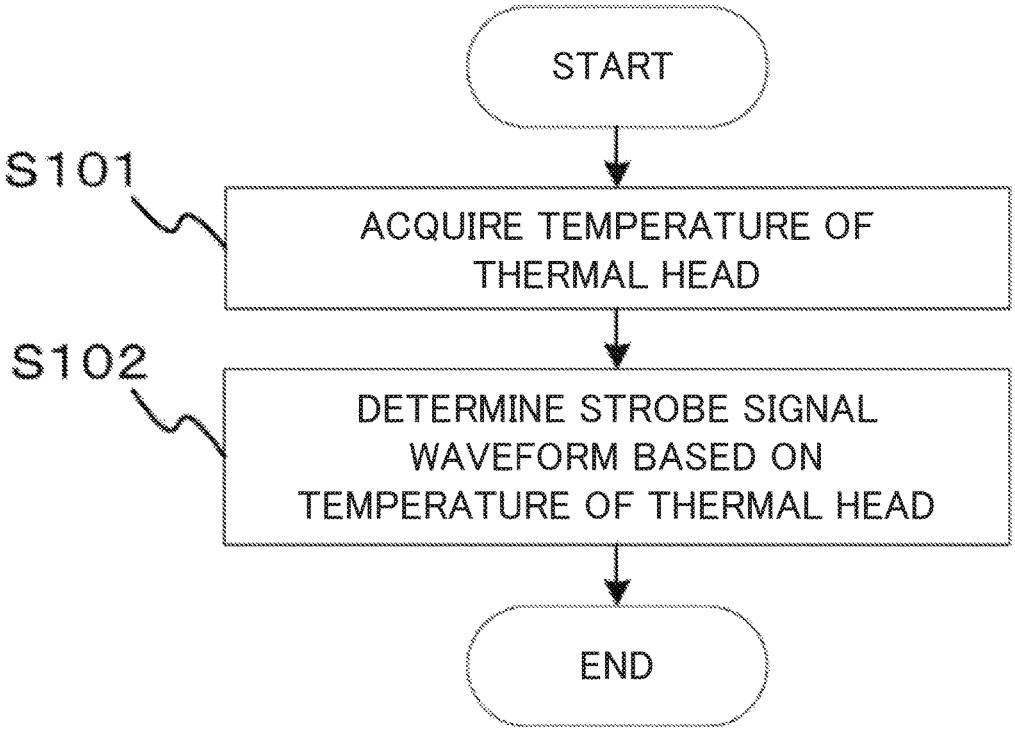
FIG. 7 is a flowchart showing an example of the strobe waveform determination procedure according to Embodiment 1 of the present disclosure.
Figure 9:
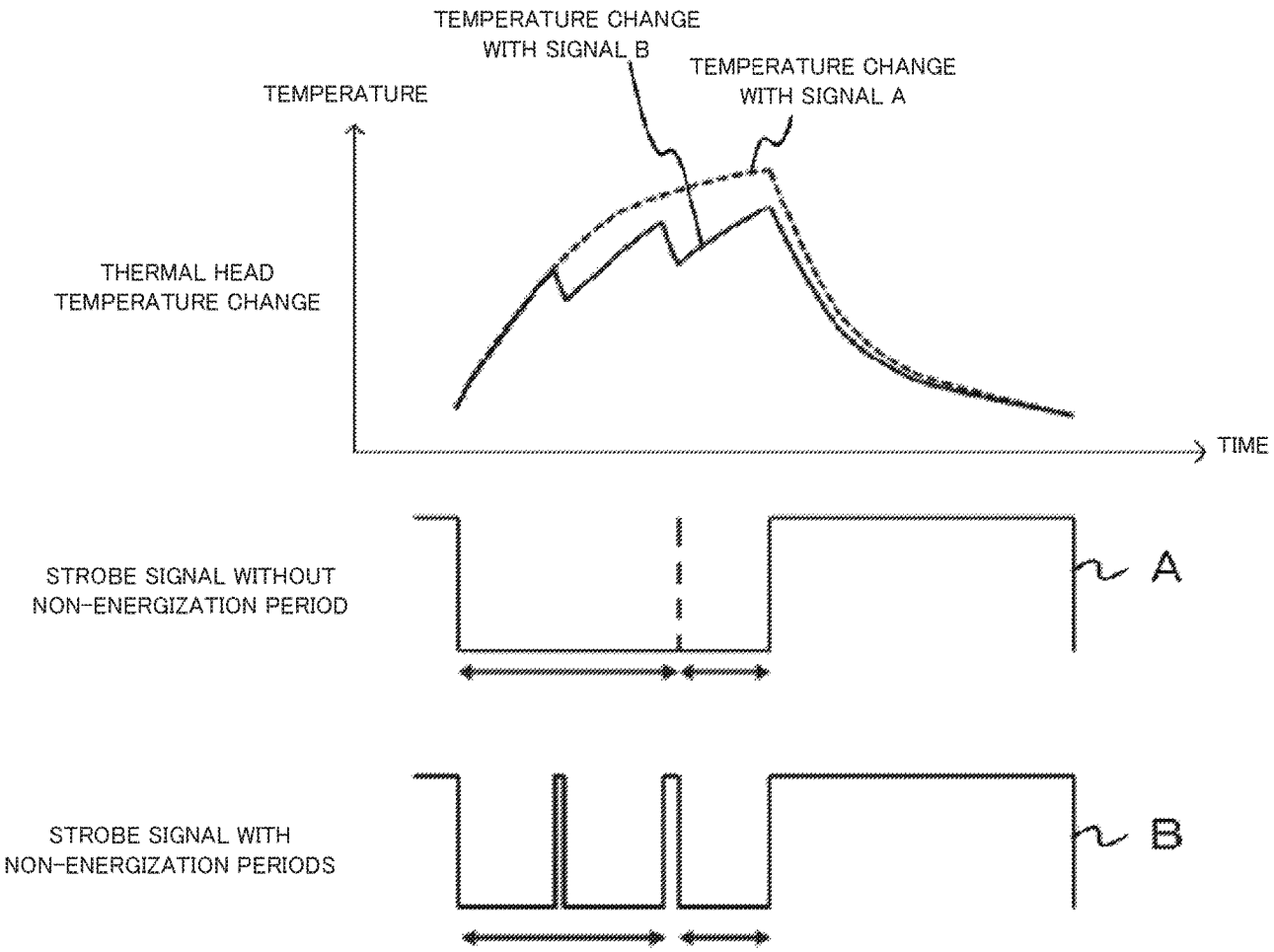
FIG. 9 is a chart showing the relationship between the strobe signal waveform and the thermal head temperature change according to Embodiment 1 of the present disclosure.

FIG. 6 is a flowchart showing an example of the print control procedure. FIG. 7 is a flowchart showing an example of the strobe waveform determination procedure. FIG. 8 is a chart showing an exemplary strobe signal and latch signal. FIG. 9 is a chart showing the relationship between the strobe signal waveform and the thermal head temperature change. The print control procedure of the printing device 1 performed by the controller 5 executing the print program will be described specifically below with reference to FIGS. 6 to 9.

As the print control procedure shown in FIG. 6 starts, the controller 5 first acquires primary energization data of a line to print next (Step S1) and generates historical energization data (Step S2). Subsequently, the controller 5 performs the strobe waveform determination procedure shown in FIG. 7 (Step S3).

In the strobe waveform determination procedure, the controller 5 first acquires the temperature of the thermal head 10 measured by the thermistor 13 (Step S101) and determines a strobe signal waveform based on the temperature of the thermal head 10 (Step S102).

In the Step S102, the controller 5 first determines an energization-controlled period T0 (μs) and an energization-uncontrolled period T3 (μs) based on the temperature of the thermal head 10 measured in the Step S101 (hereafter termed the measured temperature). The controller 5 further determines a primary energization-controlled period T1 (μs) and a historical energization-controlled period T2 (μs). Here, the energization-controlled period T0, the primary energization-controlled period T1, the historical energization-controlled period T2, and the energization-uncontrolled period T3 are determined so as to satisfy T0=T1+T2 and T=T0+T3. The energization-controlled period T0, the primary energization-controlled period T1, and the historical energization-controlled period T2 are determined so as to be longer as the measured temperature is lower. T (μs) is a period for conveying the printing medium M by one line (hereafter termed the one line cycle).

Furthermore, the controller 5 determines a first energization period Ton11 (μs), a first non-energization period Toff11 (μs), a second energization period Ton12 (μs), and a second non-energization period Toff12 (μs).

When the measured temperature is equal to or higher than a given temperature, the controller 5 determines the first energization period Ton11, the first non-energization period Toff11, the second energization period Ton12, and the second non-energization period Toff12 so as to all exceed 0 (μs) in value and satisfy T1=Ton11+Toff11+Ton12+Toff12. Moreover, the second non-energization period Toff12 is determined so as to be shorter than both the first energization period Ton11 and the second energization period Ton12. Moreover, the first non-energization period Toff11 is determined so as to be shorter than the second non-energization period Toff12. As a result, a strobe signal waveform is determined. Here, a waveform WF1 shown in FIG. 8 is an exemplary strobe signal waveform determined when the measured temperature is equal to or higher than a given temperature.

On the other hand, when the measured temperature is lower than a given temperature, the controller 5 determines the first energization period Ton11, the first non-energization period Toff11, the second energization period Ton12, and the second non-energization period Toff12 so as to satisfy Ton11=T1 and the Toff11=Ton12=Toff12=0. As a result, a strobe signal waveform is determined. Here, a waveform WF2 shown in FIG. 8 is an exemplary strobe signal waveform determined when the measured temperature is lower than a given temperature.

As a strobe signal waveform is determined, the controller 5 transfers the primary energization data acquired in the Step S1 to the head drive circuit 9 (Step S4) and sets for the first energization period Ton11 and starts the timer (Step S5).

As the timer set for the first energization period Ton11 starts, the controller 5 shifts the latch signal output to the head drive circuit 9 to ON (Step S6) so as to cause the head drive circuit 9 retain the primary energization data. Then, the controller 5 changes to ON and holds the strobe signal (Step S7) to cause the head drive circuit 9 energize the heater elements 10*a* according to the primary energization data.

Furthermore, the controller 5 transfers the historical energization data to the head drive circuit 9 during the first energization period Ton11 (Step S8). Subsequently, as the first energization period Ton11 has elapsed (Step S9: YES), the controller 5 determines whether the first non-energization period Toff11 is 0 (Step S10).

If the first non-energization period Toff11 is 0 (Step S10: YES), the controller 5 changes to OFF and holds the strobe signal (Step S11) and performs processing of Step S21. If the first non-energization period Toff11 is not 0 (Step S10: NO), the controller 5 sets for the first non-energization period Toff11 and starts the timer (Step S12).

As the timer set for the first non-energization period Toff11 starts, the controller 5 changes to OFF and holds the strobe signal (Step S13) to stop energization of the heater elements 10*a* by the head drive circuit 9. As a result, abrupt temperature rise of the heater elements 10*a* is suppressed.

Subsequently, as the first non-energization period Toff11 has elapsed (Step S14: YES), the controller 5 sets for the second energization period Ton12 and starts the timer (Step S15).

As the timer set for the second energization period Ton12 starts, the controller 5 changes to ON and holds the strobe signal (Step S16) to cause the head drive circuit 9 energize the heater elements 10*a* according to the primary energization data again. Subsequently, as the second energization period Ton12 has elapsed (Step S17: YES), the controller 5 sets for the second non-energization period Toff12 and starts the timer (Step S18).

As the timer set for the second non-energization period Toff12 starts, the controller 5 changes to OFF and holds the strobe signal (Step S19) to stop energization of the heater elements 10*a* by the head drive circuit 9. As a result, abrupt temperature rise of the heater elements 10*a* is suppressed. Subsequently, as the second non-energization period Toff12 has elapsed (Step S20: YES), the controller 5 sets for the historical energization period T2 and starts the timer (Step S21).

As the timer set for the historical energization period T2 starts, the controller 5 shifts the latch signal output to the head drive circuit 9 to ON (Step S22) so as to cause the head drive circuit 9 retain the historical energization data. Then, the controller 5 changes to ON and holds the strobe signal (Step S23) to cause the head drive circuit 9 energize the heater elements 10*a* according to the historical energization data. Subsequently, as the historical energization period T2 has elapsed (Step S24: YES), the controller 5 sets for the energization-uncontrolled period T3 and starts the timer (Step S25).

As the timer set for the energization-uncontrolled period T3 starts, the controller 5 changes to OFF and holds the strobe signal (Step S26) to stop energization of the heater elements 10*a* by the head drive circuit 9 and finish printing one line by the thermal head 10. Subsequently, the controller 5 determines whether to end the printing (Step S27).

If determined not to end the printing in the Step S27 (Step S27: NO), the controller 5 acquires primary energization data for a line to print next (Step S28) and generates historical energization data (Step S29). Subsequently, the controller 5 performs the strobe waveform determination procedure shown in FIG. 7 again (Step S30). Subsequently, as the energization-uncontrolled period T3 has elapsed (Step S31: YES), the controller 5 repeats the processing of the Steps S4 to S31 until it is determined to end the printing in the Step S27. On the other hand, if determined to end the printing in the Step S27 (Step S27: YES), the controller 5 stops the timer (Step S32) and ends the print control procedure shown in FIG. 6.

In the printing device 1 performing the print control procedure shown in FIG. 6, the controller 5 changes print data one time during an energization-controlled period, whereby gradation control can be realized. Moreover, the controller 5 establishes a non-energization period in an energization-controlled period according to the temperature of the thermal head 10, whereby temperature rise of the thermal head 10 can be suppressed compared to when no non-energization period is established as shown in FIG. 9. As a result, it is possible to prevent the temperature of the heater elements 10*a* from becoming too high. Thus, the printing device 1 can perform high quality printing regardless of the processing performance of the processor 5*a* while suppressing occurrence of broken ribbon and sticking.

Figure 10:
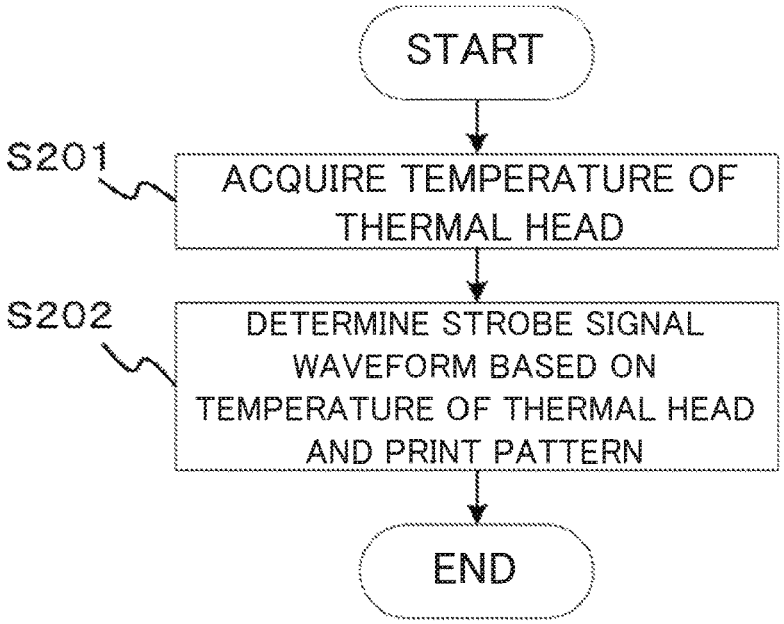
FIG. 10 is a flowchart showing another example of the strobe waveform determination procedure according to Embodiment 1 of the present disclosure.
Figure 11:
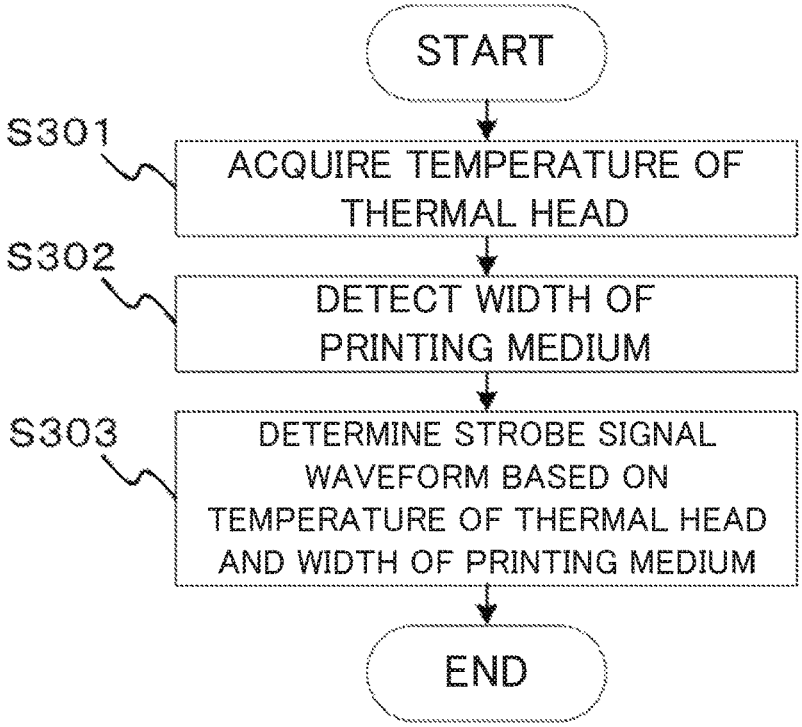
FIG. 11 is a flowchart showing a further other example of the strobe waveform determination procedure according to Embodiment 1 of the present disclosure.
Figure 12:
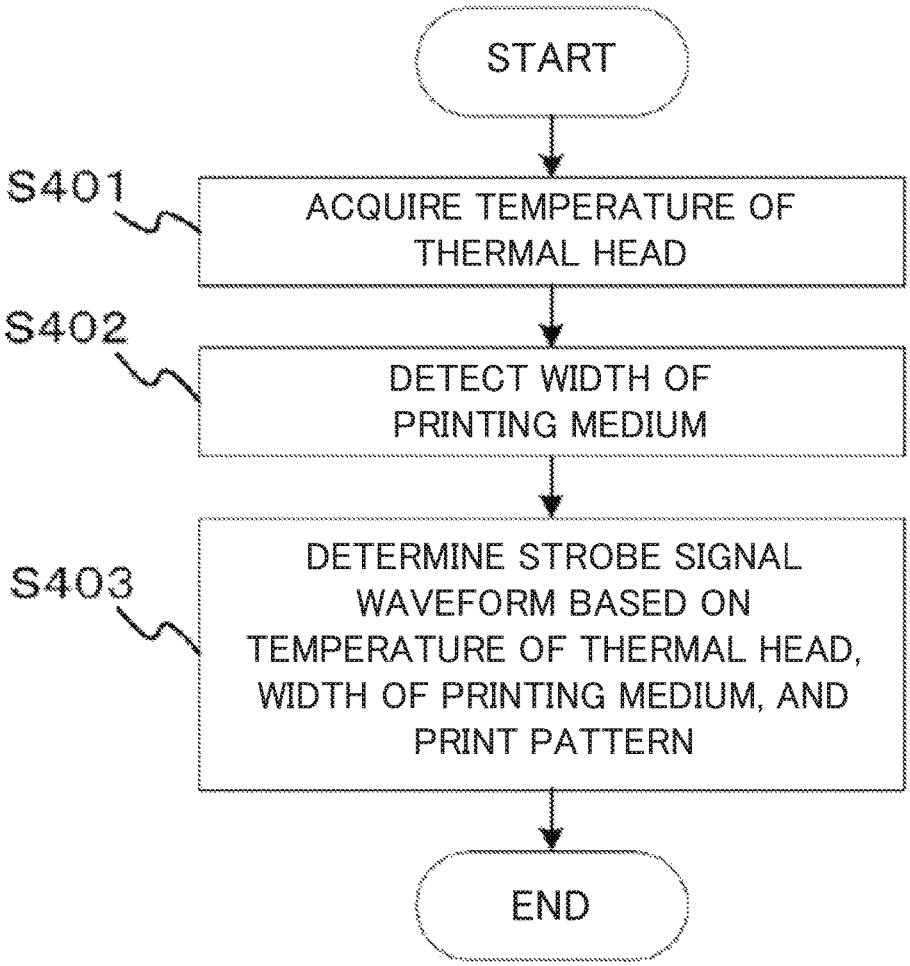
FIG. 12 is a flowchart showing a further other example of the strobe waveform determination procedure according to Embodiment 1 of the present disclosure.

A case is described above in which the controller 5 determines whether to establish a non-energization period and determines a strobe signal waveform based on the temperature of the thermal head 10. However, whether to establish a non-energization period may be determined with consideration of elements other than the temperature of the thermal head 10. FIGS. 10 to 12 are each a flowchart showing another example of the strobe waveform determination procedure.

The controller 5 may perform the strobe waveform determination procedure shown in FIG. 10 instead of the strobe waveform determination procedure shown in FIG. 7. In such a case, after acquiring the temperature of the thermal head 10 measured by the thermistor 13 (Step S201), the controller 5 determines a strobe signal waveform based on the temperature of the thermal head 10 and a print pattern presented by primary energization data (Step S202). For example, the controller 5 may lower the temperature serving as a reference for establishing a non-energization period as the number of print dots in the target line is higher or may increase the non-energization period established in an energization-controlled period as the number of print dots in the target line is higher. As a result, it is possible to suppress occurrence of broken ribbon and sticking even in cases in which the likelihood of occurrence of broken ribbon and/or sticking varies depending on the print pattern in addition to the temperature of the thermal head 10.

Moreover, the controller 5 may perform the strobe waveform determination procedure shown in FIG. 11 instead of the strobe waveform determination procedure shown in FIG. 7. In such a case, after acquiring the temperature of the thermal head 10 measured by the thermistor 13 (Step S301), the controller 5 detects the width of the printing medium M (Step S302). The controller 5 detects the width of the printing medium based on a signal from the tape width detection switches 24. Subsequently, the controller 5 determines a strobe signal waveform based on the temperature of the thermal head 10 and the width of the printing medium M (Step S303). For example, the controller 5 may establish a non-energization period in an energization-controlled period when the width of the printing medium M is equal to or smaller than a given width and the temperature of the thermal head 10 is equal to or higher than a given temperature. As a result, it is possible to suppress occurrence of broken ribbon and sticking even in cases in which the likelihood of occurrence of broken ribbon and/or sticking varies depending on the tape width in addition to the temperature of the thermal head 10.

Moreover, the controller 5 may perform the strobe waveform determination procedure shown in FIG. 12 instead of the strobe waveform determination procedure shown in FIG. 7. In such a case, after acquiring the temperature of the thermal head 10 measured by the thermistor 13 (Step S401), the controller 5 detects the width of the printing medium M from a signal from the tape width detection switches 24 (Step S402). Subsequently, the controller 5 determines a strobe signal waveform based on the temperature of the thermal head 10, the width of the printing medium M, and the print pattern (Step S403). For example, the controller 5 may establish a non-energization period in an energization-controlled period when the width of the printing medium M is equal to or smaller than a given width and the temperature of the thermal head 10 is equal to or higher than a given temperature determined based on the print dots in the target line. As a result, it is possible to suppress occurrence of broken ribbon and sticking even in cases in which the likelihood of occurrence of broken ribbon and/or sticking varies depending on the tape width and the print pattern in addition to the temperature of the thermal head 10.

FIGS. 10 to 12 show cases in which the controller 5 determines whether to establish a non-energization period based on multiple elements including the temperature of the thermal head 10 and determines the strobe signal waveform. However, whether to establish a non-energization period may be determined with consideration of the likelihood of occurrence of broken ribbon and sticking.

For example, the controller 5 may function as determination means for determining the likelihood of the ink ribbon R breaking or the likelihood of the ink ribbon R or the printing medium M sticking to the thermal head 10 based on information including at least one of the temperature of the thermal head 10, the print pattern, and the width of the printing medium M. Then, the controller 5 may control the thermal head 10 so as to establish a non-energization period in an energization-controlled period based on the determination result.

The above-described embodiment presents a specific embodiment for easier understanding of the disclosure. The present disclosure is not confined to the above-described embodiment. Various modifications and changes can be made to the printing device, the printing method of the printing device, and the program without departing from the scope of claims.

In the above-described embodiment, the printing device 1 having the input device 3 and the display 4 is described by way of example. However, the printing device 1 may be a printing device not requiring operation of the input device 3 or display of the display 4 and may be a printing device receiving print data from a computer different from the printing device 1. Moreover, in the above-described embodiment, a strobe signal waveform is determined for each line. However, a strobe signal waveform may be determined on the basis of a given number of lines.

As described above, the present disclosure can apply various changes or modifications to the above-described specific embodiment and embodiments including such changes or modifications are included in the technical scope of the present disclosure, which is apparent to a person in the field from the description in the scope of claims.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A printing device, comprising:

a thermal head comprising heater elements arrayed in a line along an array direction intersecting a conveying direction of a printing medium and an ink ribbon; and a controller that causes the thermal head to print onto the printing medium based on multiple line print data, each of the multiple line print data being data into which print data is divided along the array direction, wherein the controller performs a first energization control to energize the heater elements in an energization-controlled period of one line cycle for printing based on a content of a single line print data among the multiple line print data and a second energization control not to energize the heater elements so that a plurality of non-energization periods in which the heater elements are not energized are intermittently included in the energization-controlled period of one line cycle and so that the plurality of non-energization periods include a first non-energization period and a second non-energization period longer and later than the first energization period, and wherein the second energization control depends on a width of one of the printing medium and the ink ribbon regardless of the content of the single line print data, whereby the plurality of non-energization periods for one of a first printing medium and a first ink ribbon are set to differ in length of time from the plurality of non-energization periods for one of a second printing medium and a second ink ribbon whose width is different from a width of the one of the first printing medium and the first ink ribbon.

2. The printing device according to claim 1, wherein the controller performs the second energization control when a temperature of the thermal head is higher than a temperature range for which the controller performs the first energization control.

3. The printing device according to claim 1, wherein the controller replaces first line print data that is a portion of the print data with second line print data that is different from the first line print data, and controls the thermal head to print onto the printing medium based on the first line print data and the second line print data, in the one line cycle corresponding to a period for printing a single line print data.

4. The printing device according to claim 1, further comprising:

a switch which detects a type corresponding to a width of one of the printing medium and the ink ribbon, wherein the controller performs the second energization control in accordance with the type detected by the switch.

5. The printing device according to claim 1, wherein the controller performs the first energization control in accordance with a latch signal corresponding to the single line print data.

6. The printing device according to claim 1, wherein the controller performs a historical energization control to energize the heater elements corresponding to a historical energization data for a certain line based on the single line print data for a preceding line that is printed before the certain line.

7. The printing device according to claim 6, wherein the controller performs the historical energization control in accordance with a latch signal corresponding to an end of the non-energization period.

8. The printing device according to claim 1, wherein the controller sets the non-energization period when the width of the printing medium is equal to or smaller than a given width.

9. The printing device according to claim 1, wherein the controller sets the non-energization period when the temperature of the thermal head is equal to or higher than a given temperature.

10. The printing device according to claim 1, wherein the controller performs the second energization control such that the non-energization period for the one of the first printing medium and the first ink ribbon is set to differ in length of time from the non-energization period for the one of the second printing medium and the second ink ribbon even if a temperature of the thermal head for printing on the first printing medium equals a temperature of the thermal head for printing on the second printing medium and the multiple line print data for the first printing medium is the same as the multiple line print data for the second printing medium.

11. The printing device according to claim 1, wherein the controller sets a length of time of an energization-uncontrolled period of the one line cycle based on a temperature of the thermal head, the energization-uncontrolled period being a time to stop energization of the heater elements after the energization-controlled period.

12. A printing device, comprising:

a thermal head comprising heater elements arrayed in a line along an array direction intersecting a conveying direction of a printing medium and an ink ribbon; and a controller that causes the thermal head to print onto the printing medium based on multiple line print data, each of the multiple line print data being data into which print data is divided along the array direction, wherein the controller performs a first energization control to energize the heater elements in an energization-controlled period of one line cycle for printing based on a content of a single line print data among the multiple line print data, a second energization control not to energize the heater elements so that a non-energization period in which the heater elements are not energized is included in the energization-controlled period, and a historical energization control, in accordance with a latch signal corresponding to an end of the non-energization period, to energize the heater elements corresponding to a historical energization data for a certain line based on the single line print data for a preceding line that is printed before the certain line, and wherein the second energization control depends on a width of one of the printing medium and the ink ribbon regardless of the content of the single line print data, whereby the non-energization period for one of a first printing medium and a first ink ribbon is set to differ in length of time from the non-energization period for one of a second printing medium and a second ink ribbon whose width is different from a width of the one of the first printing medium and the first ink ribbon.

13. The printing device according to claim 12, wherein the controller further performs the second energization control not to energize the heater elements in another non-energization period included in the energization-controlled period, the another non-energization period preceding the non-energization period.

14. A printing method executed by a controller of a printing device, wherein the printing device further comprises a thermal head comprising heater elements arrayed in a line along an array direction intersecting a conveying direction of a printing medium and an ink ribbon, and wherein the printing method includes:

causing the thermal head to print onto the printing medium based on multiple line print data, each of the multiple line print data being data into which print data is divided along the array direction, and performing a first energization control to energize the heater elements in an energization-controlled period of one line cycle for printing based on a content of a single line print data among the multiple line print data and a second energization control not to energize the heater elements so that a plurality of non-energization periods in which the heater elements are not energized are intermittently included in the energization-controlled period of one line cycle and so that the plurality of non-energization periods include a first non-energization period and a second non-energization period longer and later than the first non-energization period, wherein the second energization control depends on a width of one of the printing medium and the ink ribbon regardless of the content of the single line print data, whereby the plurality of non-energization periods for one of a first printing medium and a first ink ribbon are set to differ in length of time from the plurality of non-energization periods for one of a second printing medium and a second ink ribbon whose width is different from a width of the one of the first printing medium and the first ink ribbon.

15. A nonvolatile recording medium on which a computer-readable program is stored, the program causing a controller of a printing device to execute processing comprising:

causing a thermal head provided to the printing device to print onto a printing medium based on multiple line print data, each of the multiple line print data being data into which print data is divided along the array direction, and performing a first energization control to energize heater elements in an energization-controlled period of one line cycle for printing based on a content of a single line print data among the multiple line print data and a second energization control not to energize the heater elements so a plurality of non-energization periods in which the heater elements are not energized are intermittently included in the energization-controlled period of one line cycle and so that the plurality of non-energization periods include a first non-energization period and a second non-energization period longer and later than the first non-energization period, wherein the second energization control depends on a width of one of the printing medium and an ink ribbon regardless of the content of the single line print data, whereby the plurality of non-energization periods for one of a first printing medium and a first ink ribbon are set to differ in length of time from the plurality of non-energization periods for one of a second printing medium and a second ink ribbon whose width is different from a width of the one of the first printing medium and the first ink ribbon.

* * * * *